US012808190B2

(12) United States Patent
Haba et al.

(10) Patent No.: US 12,808,190 B2
(45) Date of Patent: Nov. 24, 2026

(54) BLOCKING COMPONENT FOR CONSTRUCTION FRAMING ASSEMBLY AND CONSTRUCTION

(71) Applicant: Telling Industries, LLC, Willoughby, OH (US)

(72) Inventors: Charles Andrew Haba, Kirtland, OH (US); William J. Gibbs, Byesville, OH (US); Thomas D. Ogle, York, SC (US); Michael L. Stoner, New Concord, OH (US)

(73) Assignee: Telling Industries, LLC, Willoughby, OH (US)

( * ) Notice: Subject to any disclaimer, the term of this patent is extended or adjusted under 35 U.S.C. 154(b) by 192 days.

(21) Appl. No.: 18/747,770

(22) Filed: Jun. 19, 2024

(65) Prior Publication Data

US 2024/0401333 A1 Dec. 5, 2024

Related U.S. Application Data

(63) Continuation-in-part of application No. 17/985,838, filed on Nov. 12, 2022, now abandoned.

(60) Provisional application No. 63/264,960, filed on Dec. 6, 2021.

(51) Int. Cl.

| | |
|---|---|
| ***B21D 5/08*** | (2006.01) |
| ***E04C 3/07*** | (2006.01) |
| *E04C 3/04* | (2006.01) |

(52) U.S. Cl.

CPC ..... *E04C 3/07* (2013.01); *B21D 5/08* (2013.01); *E04C 2003/0408* (2013.01)

(58) Field of Classification Search

CPC ..... B21D 5/06; B21D 5/08

See application file for complete search history.

(56) References Cited

U.S. PATENT DOCUMENTS

| | | | | |
|---|---|---|---|---|
| 5,647,186 | A | 7/1997 | Donaldson | |
| 6,813,919 | B1 * | 11/2004 | Ellis | B21D 5/08 72/181 |
| 7,559,519 | B1 | 7/2009 | Dragic et al. | |
| 8,141,319 | B2 | 3/2012 | Brady | |
| 8,281,544 | B2 | 10/2012 | Brady | |
| 8,833,030 | B2 | 9/2014 | Zimmerman et al. | |
| 9,085,912 | B2 | 7/2015 | Brady | |
| 9,103,108 | B2 | 8/2015 | Lin | |

(Continued)

FOREIGN PATENT DOCUMENTS

| | | | |
|---|---|---|---|
| GB | 422765 | A | 1/1935 |

OTHER PUBLICATIONS

The Steel Network, BackIt®, Dec. 31, 2022.

Simpson Strong—Tie Company, The WBAC Connector Attaches Wood Backing to Steel Studs Securely and Easily, Dec. 31, 2022.

*Primary Examiner* — Debra M Sullivan

(74) *Attorney, Agent, or Firm* — Sisson & Banyas, Attorneys at Law, LLC; Edwin A. Sisson

(57) ABSTRACT

A construction framing blocking component comprises a web, a first flange, a second flange, a first ear, a second ear, a third ear, and a fourth ear. Each flange has a first edge attached to a web first edge and extends away from the web bottom surface. Each ear extends from a flange end. The blocking component may be made by cold roll forming which bends a planar piece of steel into the web and two flanges and then remove a portion of the web on opposing sides to create the ears.

10 Claims, 7 Drawing Sheets

(56) References Cited

U.S. PATENT DOCUMENTS

| | | | | |
|---|---|---|---|---|
| 9,523,196 | B2 | 12/2016 | Rice | |
| 2015/0118951 | A1* | 4/2015 | Beneke | F24F 13/0245 29/525 |

* cited by examiner

BLOCKING COMPONENT FOR CONSTRUCTION FRAMING ASSEMBLY AND CONSTRUCTION

CROSS REFERENCES AND PRIORITIES

This application is continuation in part application claiming priority from U.S. patent application Ser. No. 17/985,838 filed on 12 Nov. 2022 which claims priority from Provisional Patent Application 63/264,960 filed on 6 Dec. 2021, the teachings of which both applications are incorporated herein in their entirety.

BACKGROUND

When constructing a building such as a home, office building, industrial building, or warehouse internal-to-the-wall supports are often needed for the attachment of external-to-the wall cabinets, handrails, and other load bearing items. Such internal-to-the wall supports are commonly referred to as blocking.

Early blocking consisted of a simple piece of wood block which extended horizontally between two wooden studs. However, the proliferation of metal framing assemblies to replace wooden studs brought about different solutions typically using metal blocking components.

The simplest metal blocking component comprises a flat piece of metal known as a strap which extends horizontally between and is attached to two metal studs. One such solution is known as True Flatstrap and is available from Telling Industries, Willoughby, Ohio, U.S.A.

While flat pieces of metal have been found useful for attachment of lighter weight external-to-the wall elements, they are often insufficient for heavier external-to-the wall elements such large cabinets. Due to their relatively low load-bearing capacity, the flat pieces of metal will fail over time. Failure typically occurs at or around the attachment mechanism (i.e.—screw) which attaches the flat piece of metal to the stud. In part due to these reasons, flat pieces of metal often fail to meet the load requirements outlined in Standard 1910.29 (Fall Protection for Handrails), Dec. 17, 2019 from the United States Department of Labor's Occupational Safety and Health Administration (OSHA).

Many solutions have been proposed for blocking to be used with metal studs. In general, these solutions utilize a hollow "C" shaped channel which extends horizontally between and is attached to two metal studs.

In practice, solutions utilizing a hollow "C" shaped channel require an attachment means which is folded or precision machined from the "C" shaped channel to allow for connection to the stud. In practice, it has been found that such solutions are often difficult to manufacture. Additionally, when the attachment means is folded from the "C" shaped channel, the folding process often introduces failure points which result in the blocking component breaking over time. Many "C" shaped channel type metal blocking components have also been found to be difficult to install, requiring precision alignment of the blocking component relative to the studs.

The need exists, therefore, for an improved blocking component which is simple to manufacture and install, and which is capable of withstanding higher weight loads.

SUMMARY

Disclosed herein is a blocking component for a construction framing assembly. The blocking component comprises a web, a first flange, a second flange, a first ear, a second ear, a third ear, and a fourth ear. The web has a web first edge, a web second edge substantially parallel with and opposite the web first edge, a web first end substantially perpendicular with the web first edge, a web second end substantially parallel with and opposite the web first end, a web top surface, and a web bottom surface.

The first flange has a first flange first edge, a first flange second edge substantially parallel with and opposite the first flange first edge, a first flange first end substantially perpendicular with the first flange first edge, and a first flange second end substantially parallel with and opposite the first flange first end. The first flange first edge is attached to the web first edge with the first flange extending away from the web bottom surface.

The second flange has a second flange first edge, a second flange second edge substantially parallel with and opposite the second flange first edge, a second flange first end substantially perpendicular with the second flange first edge, and a second flange second end substantially parallel with and opposite the second flange first end. The second flange first edge is attached to the web second edge with the second flange extending away from the web bottom surface.

The first ear extends from the first flange first end. The second ear extends from the first flange second end. The third ear extends from the second flange first end. The fourth ear extends from the second flange second end.

Also disclosed herein is a construction framing assembly comprising the blocking component and a plurality of studs comprising at least a first stud and a second stud. The first ear is attached to a first surface of the first stud. The second ear is attached to a first surface of the second stud. The third ear is attached to a second surface of the first stud. The fourth ear is attached to a second surface of the second stud.

The first ear has a first ear length dimension. In some embodiments, the first ear length dimension relative to a stud leg width dimension of the first stud of the construction framing assembly may be in a range of between 50% and 100%.

The second ear has a second ear length dimension. In some embodiments, the second ear length dimension relative to a stud leg width dimension of the second stud of the construction framing assembly may be in a range of between 50% and 100%.

The third ear has a third ear length dimension. In some embodiments, the third ear length dimension relative to a stud leg width dimension of the first stud of the construction framing assembly may be in a range of between 50% and 100%.

The fourth ear has a fourth ear length dimension. In some embodiments, the fourth ear length dimension relative to a stud leg width dimension of the second stud of the construction framing assembly may be in a range of between 50% and 100%.

In some embodiments, the first ear may be attached to the first surface of the first stud by a first fastener. The second ear may be attached to the first surface of the second stud by a second fastener. The third ear may be attached to the second surface of the first stud by a third fastener. The fourth ear may be attached to the second surface of the second stud by a fourth fastener. In certain embodiments, each of the first fastener, the second fastener, the third fastener, and the fourth fastener may independently be selected from the group consisting of a bolt, a screw, a rivet, a clamp, and a pin.

In certain embodiments, the first ear may be attached to the first surface of the first stud by a snap fit mechanism. The second ear may be attached to the first surface of the second stud by a snap fit mechanism. The third ear may be attached to the second surface of the first stud by a snap fit mechanism. The fourth ear may be attached to the second surface of the second stud by a snap fit mechanism.

In some embodiments, the first ear may be permanently attached to the first surface of the first stud by welding or gluing. The second ear may be permanently attached to the first surface of the second stud by welding or gluing. The third ear may be permanently attached to the second surface of the first stud by welding or gluing. The fourth ear may be permanently attached to the second surface of the second stud by welding or gluing.

It is also discloses that there is an angle formed by the web first edge and the first stud which can be about 90° or 90°.

It is not a right angle or the angle is not 90°, then the angle formed by the first stud and the web first edge measured to the web top side is in a range selected from the group consisting of between about 45° and less than 90° and between greater than 90° and about 135°.

DETAILED DESCRIPTION

Disclosed herein is a blocking component for construction framing assembly. Also disclosed here in is a construction framing assembly comprising a plurality of studs and at least one blocking component. The blocking component and construction framing assembly are described below with reference to the Figures. As described herein and in the claims, the following numbers refer to the following structures noted in the Figures.

10 refers to construction framing assembly.
20 refers to a first stud.
25 refers to a stud leg width.
30 refers to a second stud.
40 refers to a track.
100 refers to a blocking component.
110 refers to a web.
111 refers to a web first edge.
112 refers to a web second edge.
113 refers to a web first end.
114 refers to a web second end.
115 refers to a web top surface.
116 refers to a web bottom surface.
120 refers to a first flange.
121 refers to a first flange first edge.
122 refers to a first flange second edge.
123 refers to a first flange first end.
124 refers to a first flange second end.
130 refers to a second flange.
131 refers to a second flange first edge.
132 refers to a second flange second edge.
133 refers to a second flange first end.
134 refers to a second flange second end.
140 refers to a first ear.
145 refers to an ear length.
150 refers to a second ear.
160 refers to a third ear.
170 refers to a fourth ear.
200 refers to a fastener.

Figure 1:
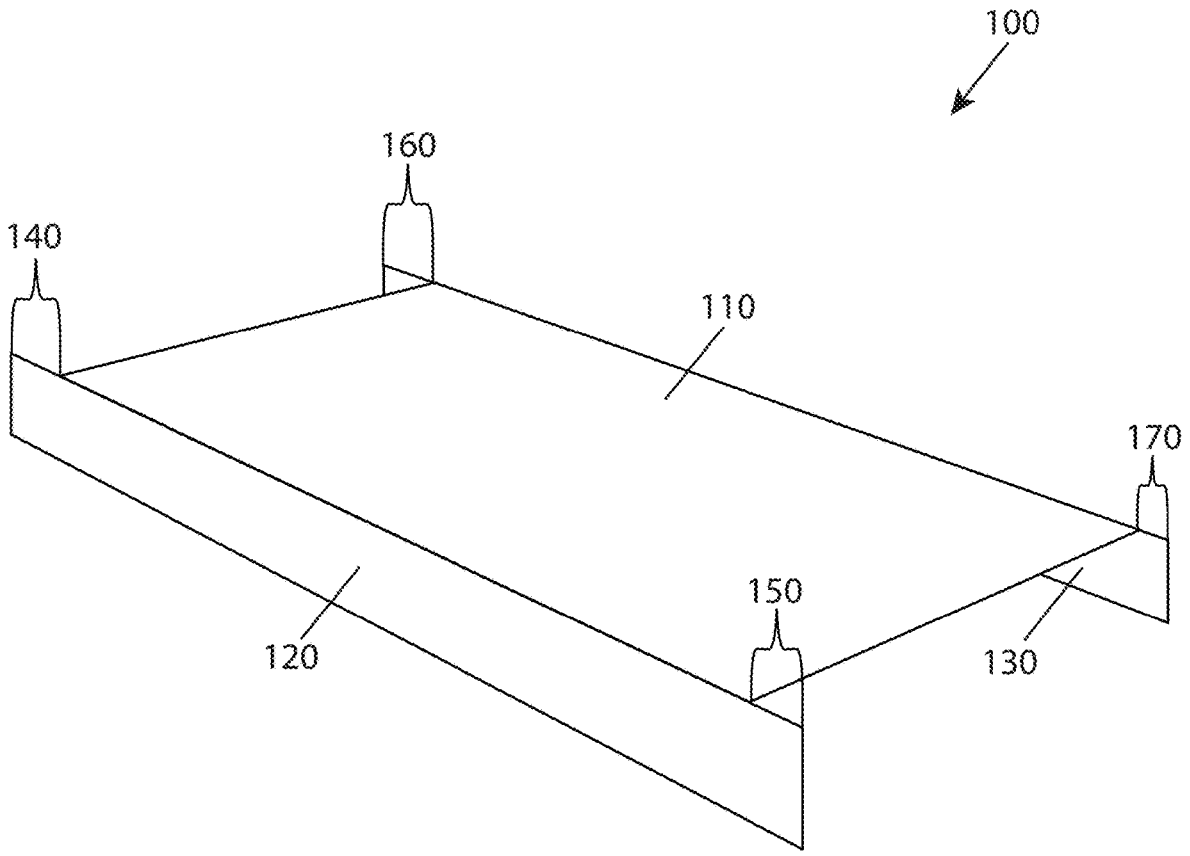
FIG. 1 depicts a perspective view of one embodiment of a blocking component.

FIG. 1 shows a perspective view of one embodiment of a blocking component (100) for construction framing assembly (10). As shown in FIG. 1, the blocking component comprises a web (110), a first flange (120), a second flange (130), a first ear (140), a second ear (150), a third ear (160), and a fourth ear (170).

Figure 2:
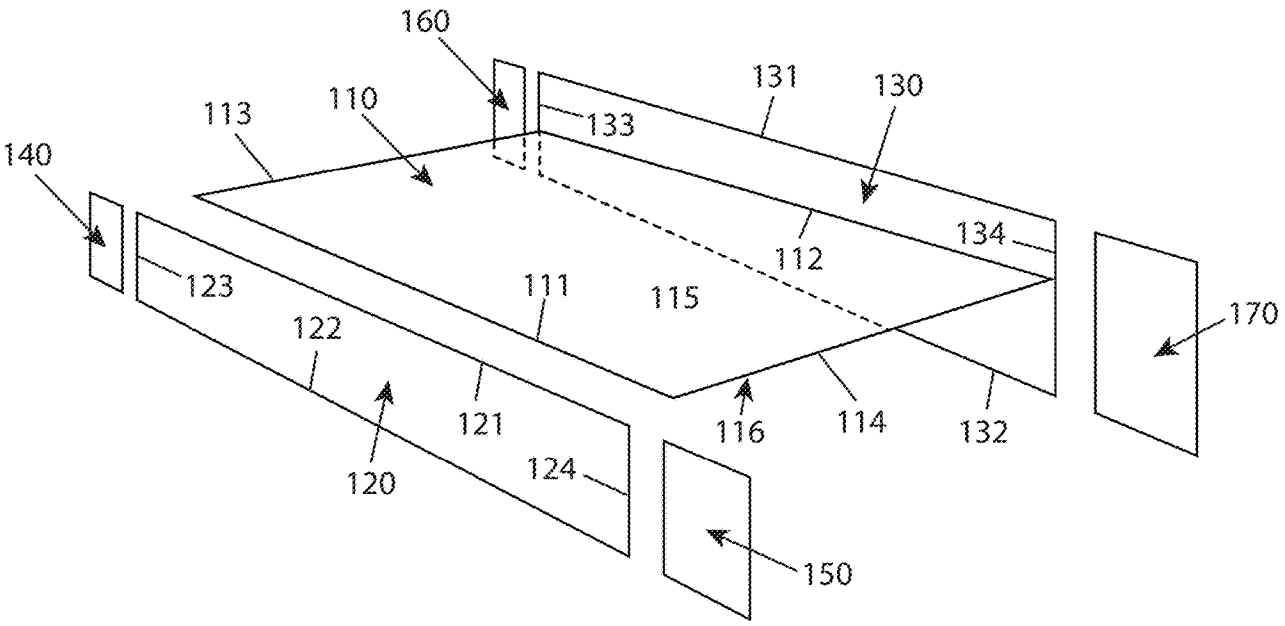
FIG. 2 depicts an exploded perspective view of the embodiment of a blocking component of FIG. 1.

FIG. 2 shows an exploded perspective view of the embodiment of a blocking component (100) for construction framing assembly (10) of FIG. 1. As shown in FIG. 2, the web (110) has a substantially rectangular or rectangular planar profile. That is to say that the web has a web first edge (111) and a web second edge (112) which is parallel/substantially parallel with and opposite of the web first edge. The web also has a web first end (113) which is perpendicular/substantially perpendicular with the web first edge and a web second end (114) which is parallel/substantially parallel with and opposite the web first end. As the web forms a substantially rectangular or rectangular planar profile, the web also has a web top surface (115) and a web bottom surface (116) which is opposite the web top surface as shown in FIG. 2.

Also shown in FIG. 2 is the first flange (120). As shown in FIG. 2, the first flange may have a substantially rectangular or rectangular planar profile. That is to say that the first flange may have a first flange first edge (121) and a first flange second edge (122) which is parallel/substantially parallel with and opposite the first flange first edge. The first flange may also have a first flange first end (123) which is perpendicular/substantially perpendicular with the first flange first edge and a first flange second end (124) which is parallel/substantially parallel with and opposite the first flange first end.

Referring back to FIG. 1, the first flange first edge (121) may be attached to the web first edge (111) with the first flange extending away from the web bottom surface (116). Attaching the first flange first edge to the web first edge may be done by any number of methods. Preferably, the first flange first edge will be permanently attached to the web first edge such as by manufacturing the web (110) and the first flange (120) of a single integral piece of material, or by welding the first flange first edge to the web first edge.

A second flange (130) is shown in FIG. 2. As shown in FIG. 2, the second flange may have a substantially rectangular or rectangular planar profile. That is to say that the second flange may have a second flange first edge (131) and a second flange second edge (132) which is parallel/substantially parallel with and opposite the second flange first edge. The second flange may also have a second flange first end (133) which is perpendicular/substantially perpendicular with the second flange first edge and a second flange second end (134) which is parallel/substantially parallel with and opposite the second flange first end.

Referring back to FIG. 1, the second flange first edge (131) may be attached to the web second edge (112) with the second flange extending away from the web bottom surface (116). Attaching the second flange first edge to the web second edge may be done by any number of methods. Preferably, the second flange first edge will be permanently attached to the web second edge such as by manufacturing the web (110) and the second flange (130) of a single integral piece of material, or by welding the second flange first edge to the web second edge.

FIG. 1 and FIG. 2 also shows a first ear (140). As shown in FIG. 1, the first ear is attached to and extends from the first flange first end (123). Attaching the first ear to the first flange first end may be done by any number of methods. Preferably, the first ear will be permanently attached to the first flange first end such as by manufacturing the first ear and the first flange (120) of a single integral piece of material, or by welding the first ear to the first flange first end.

Also shown in FIG. 1 and FIG. 2 is a second ear (150). As shown in FIG. 1, the second ear is attached to and extends from the first flange second end (124). Attaching the second ear to the first flange second end may be done by any number of methods. Preferably, the second ear will be permanently attached to the first flange second end such as by manufacturing the second ear and the first flange (120) of a single integral piece of material, or by welding the second ear to the first flange second end.

Further shown in FIG. 1 and FIG. 2 is a third ear (160). As shown in FIG. 1, the third ear is attached to and extends from the second flange first end (133). Attaching the third ear to the second flange first end may be done by any number of methods. Preferably, the third ear will be permanently attached to the second flange first end such as by manufacturing the third ear and the second flange (130) of a single integral piece of material, or by welding the third ear to the second flange first end.

FIG. 1 and FIG. 2 further shows a fourth ear (170). As shown in FIG. 1, the fourth ear is attached to and extends from the second flange second end (134). Attaching the fourth ear to the second flange second end may be done by any number of methods. Preferably, the fourth ear will be permanently attached to the second flange second end such as by manufacturing the fourth ear and the second flange (130) of a single integral piece of material, or by welding the fourth ear to the second flange second end.

Figure 3:
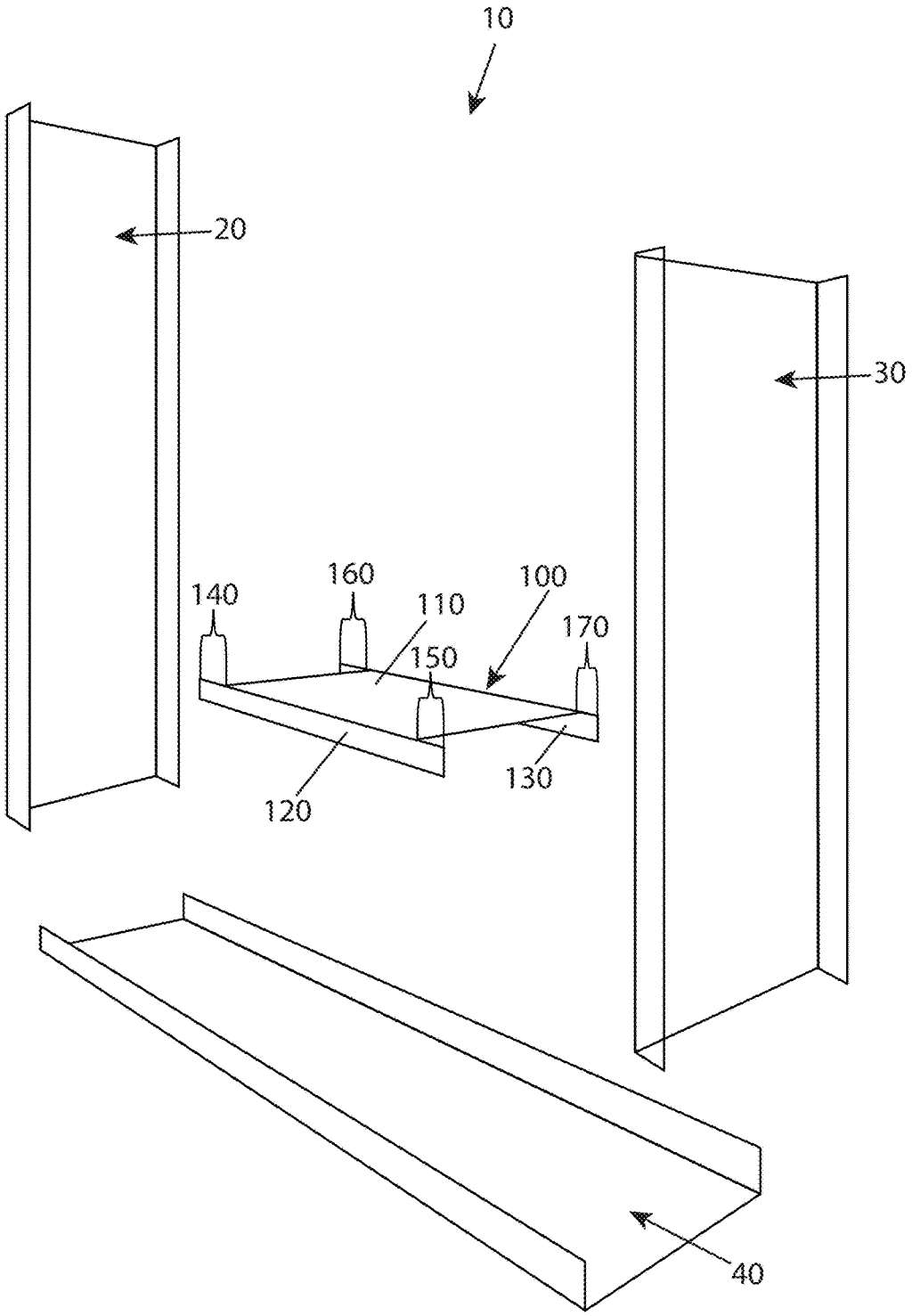
FIG. 3 depicts an exploded view of an embodiment of construction framing assembly comprising a blocking component.

FIG. 3 shows an exploded perspective view of construction framing assembly (10) comprising a blocking component (100) of the type described herein. As shown in FIG. 3, the construction framing assembly comprises a plurality of studs comprising at least a first stud (20) and a second stud (30). The construction framing assembly further comprises at least one blocking component (100). Each stud of the plurality of studs may be of any type commonly used in building construction. Commonly, the studs will be made of rigid construction material such as steel or wood. In some embodiments, the stud(s) may be formed as a "C" shaped metal channel with each stud having a corresponding stud web, stud first flange, and stud second flange.

As shown in FIG. 3, each stud of the plurality of studs will extend vertically between a floor and a ceiling or roof of a building. Commonly, the studs will be affixed at each end to a plate or track (40) by a plurality of fasteners (not shown). The plate or track extends substantially parallel with the corresponding floor, ceiling, or roofline.

Figure 4:
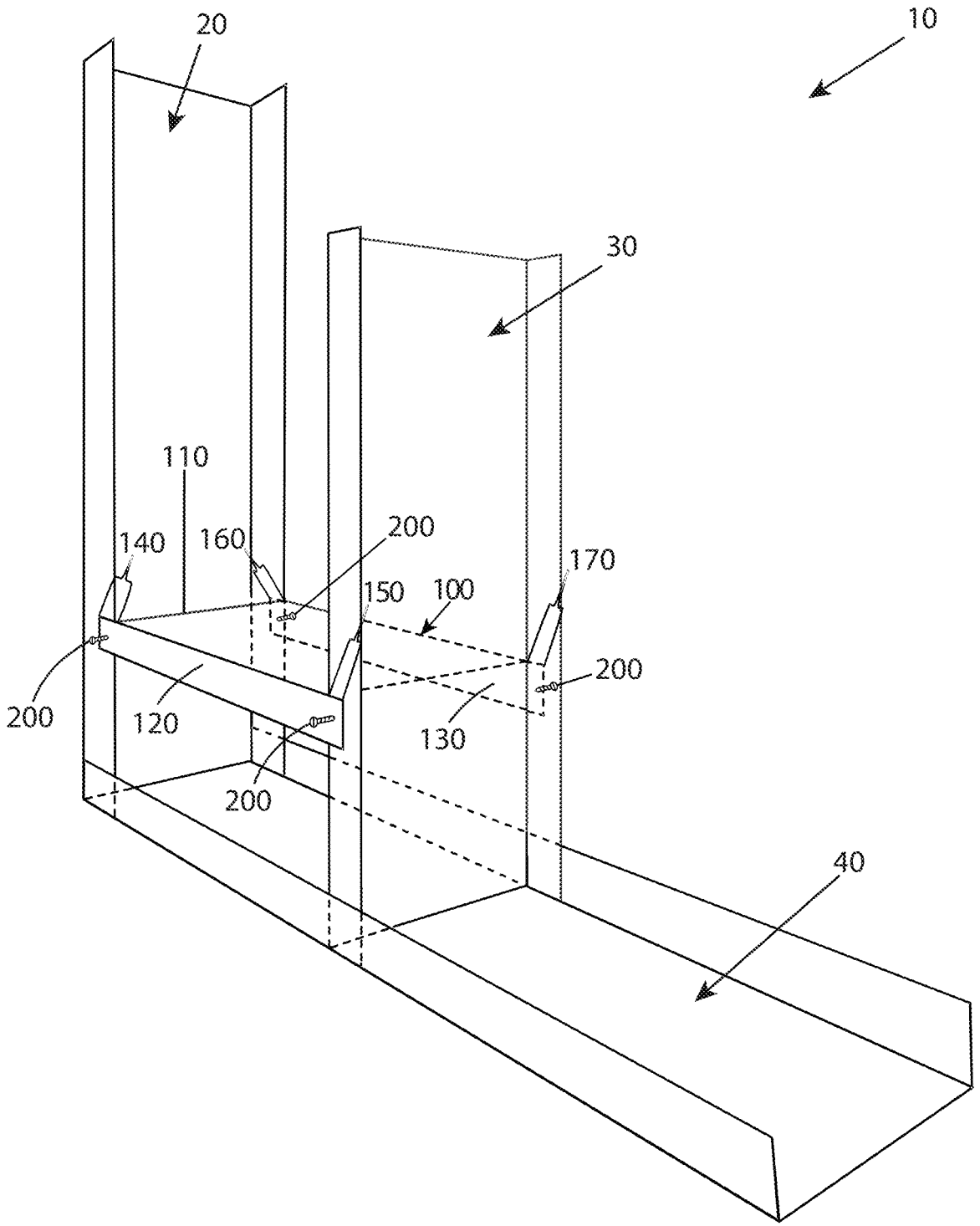
FIG. 4 depicts an assembled view of the embodiment of construction framing assembly comprising a blocking component of FIG. 3.

FIG. 4 shows an assembled perspective view of the construction framing assembly (10) of FIG. 3. As shown in FIG. 4, the blocking component (100) extends between and is attached to the first stud (20) and the second stud (30). More specifically, the first ear (140) of the blocking component is attached to a first surface of the first stud while the third ear (160) of the blocking component is attached to a second surface of the first stud which is opposite of the first surface of the first stud. Similarly, the second ear (150) of the blocking component is attached to the first surface of the second stud while the fourth ear (170) of the blocking component is attached to a second surface of the second stud which is opposite the first surface of the second stud.

The attachment of the blocking component (100) and the two studs (20/30) may take many forms. In some embodiments, the attachment may be a non-permanent attachment in which a fastener (200)—such as a bolt, screw, rivet, clamp, pin, or the like—attaches the corresponding ear to the stud. Other non-permanent attachments may include a bent over tab and/or a snap fit attachment mechanism. In other embodiments, the attachment may be a permanent attachment such as welding or gluing the corresponding ear to the stud.

Figure 5:
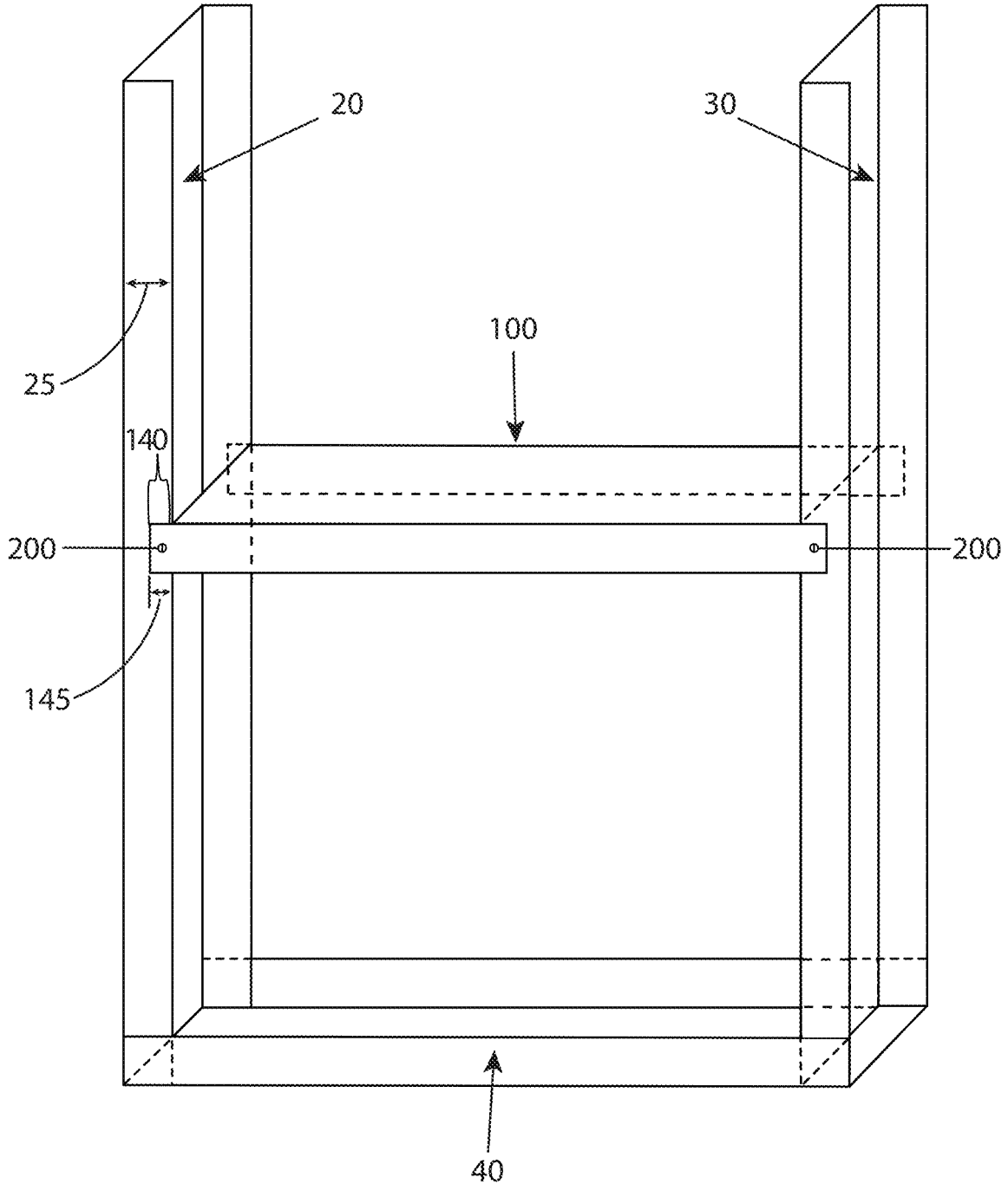
FIG. 5 depicts a close-up view of an embodiment of an ear of a blocking component attached to a stud.

FIG. 5 shows a close-up view of one embodiment of an ear (which in the case of FIG. 5 is labelled as the first ear (140) but may also be the second ear, the third ear, or the fourth ear) attached to a stud (which in the case of FIG. 5 is labelled as the first stud (20) but may also be the second stud or a subsequent stud). As shown in FIG. 5, the ear has an ear length (145) while the stud has a studs leg width (25). Preferably, the dimension of the ear length will be at least 50% of the dimension of the stud leg width.

In the embodiment in FIG. 5, the dimension of the ear length (145) is 50% of the dimension of the stud leg width (25). That is to say that, where the stud leg width has a dimension of four inches, the ear length has a dimension of two inches. This allows for multiple blocking components to be connected between three or more studs with each blocking component being attached at the same height along the length of the studs.

Figure 6:
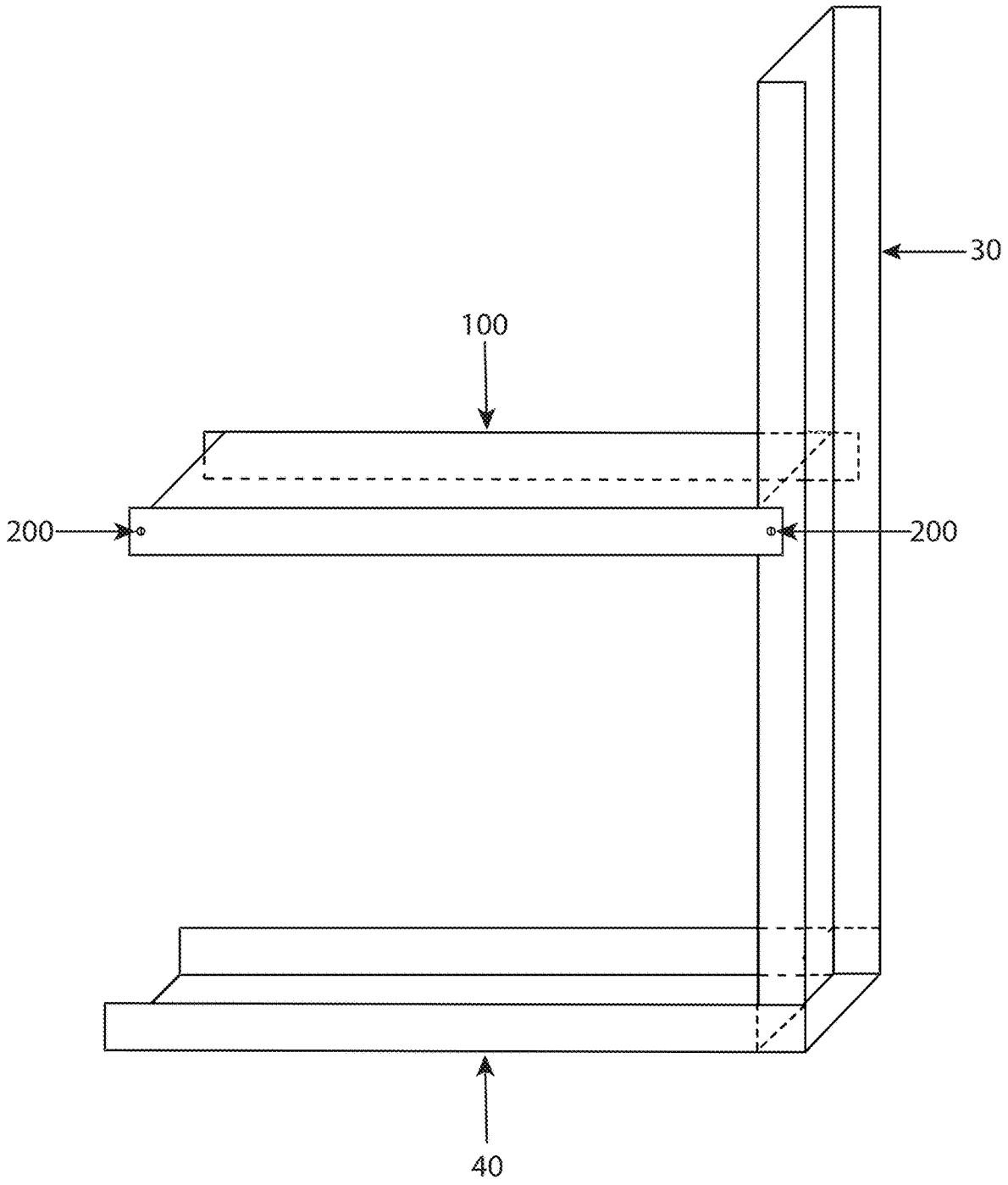
FIG. 6 depicts a close-up view of the test assembly used to generate the data for Table IV.

FIG. 6 is the embodiment used in the experimental setup.

Figure 7:
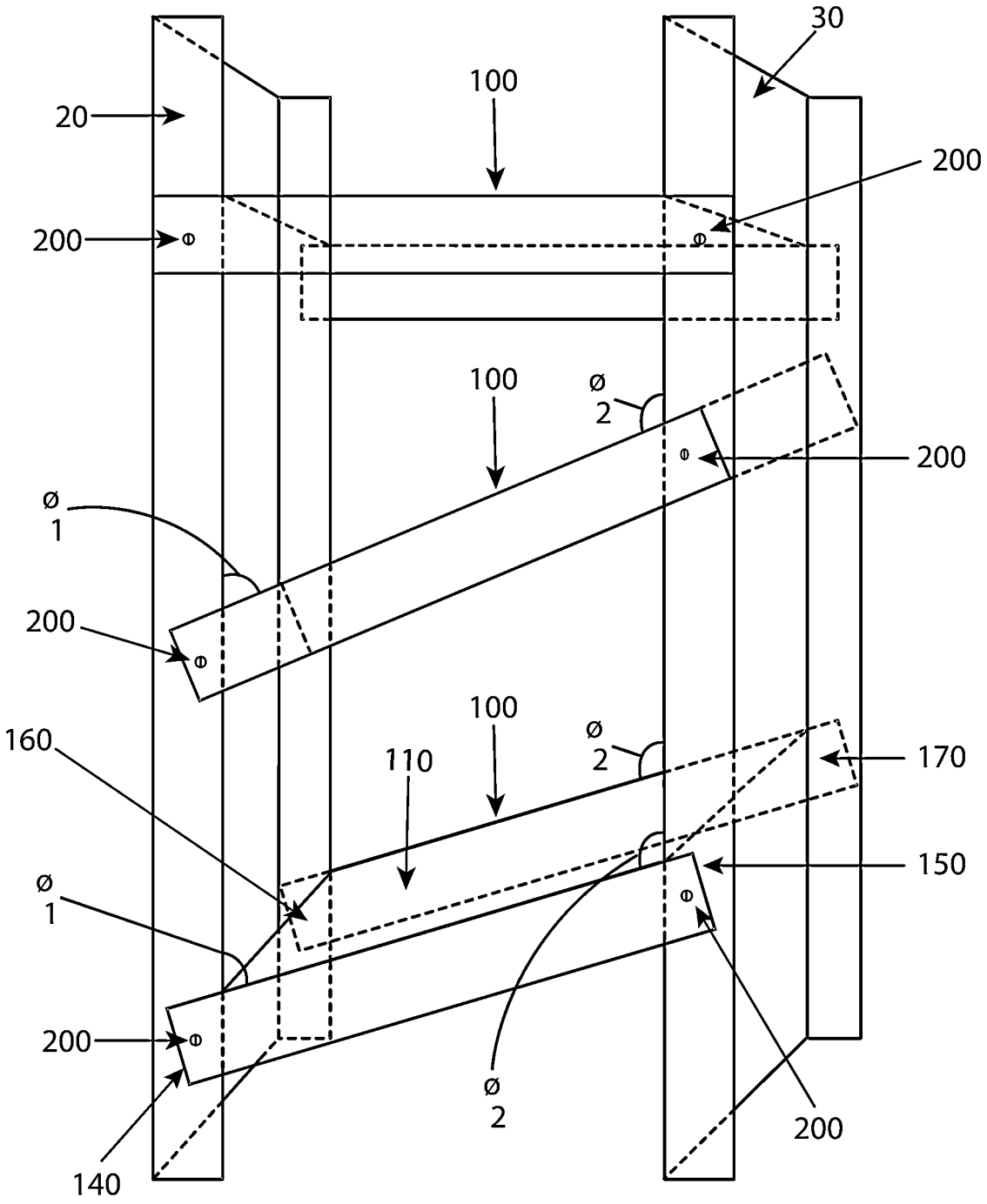
FIG. 7 shows two embodiments of the assembly.

FIG. 7 shows two embodiments of the assembly. The first, or top embodiment, is where the web of blocking component is perpendicular, or substantially perpendicular with at least one of the two studs, if not both the studs, assuming the studs are parallel with each other.

In its simplest reduction, at least one of the web edges (111 or 112) is perpendicular to at least one stud. That is, the angle formed by at least one of the web edges (111 or 112), which is also the web (160) and the corresponding stud is approximately 90°.

In another embodiment the blocking component may be slanted up or down from the left to the right depending upon one's perspective. This is shown in FIG. 7 in the middle embodiment which is a side view and the bottom embodiment which is the perspective view. More definitively, the angle formed by at least one of the web edges and one of the studs $Ø_1$ is between about 45° and less than 90° on one side of the web and about 145° to less than about 180° when measured on the opposite side of the web. Alternatively, as shown in FIG. 7 in the middle and bottom embodiments, there is a $Ø_2$ which is the corresponding complementary angle to $Ø_1$. It is the angle formed by the web edge or web with the second stud attached to the blocking component. As the angles are complementary, the sum of $Ø_1$ and $Ø_2$ is 90, provided the web edge of the blocking component is straight and the two studs are parallel to each other.

Alternatively, the angle formed by the first web edge and the first stud may be an angle other than 90°. As the web edge is straight, this describes the possible non-horizontal configurations.

In other embodiments—not shown—the dimension of the ear length (145) may be up to 100% of the dimension of the stud leg width (25). That is to say that, where the stud leg width has a dimension of four inches, the ear length has a dimension of four inches. The dimension of the ear length relative to the dimension of the stud leg width may also be expressed as a range selected from the group consisting of between 50% and 100%, between 50% and 90%, between 50% and 80%, between 50% and 70%, between 50% and 60%, between 60% and 100%, between 60% and 90%, between 60% and 80%, between 60% and 70%, between 70% and 100%, between 70% and 90%, between 70% and 80%, between 80% and 100%, between 80% and 90%, and between 90% and 100%.

The gauge of the blocking component may be about 16 ga or about 20 ga, preferably between 15 and 25 ga.

The yield strength force of the steel used for the blocking component may be preferably about 50 ksi or about 33 ksi, with the range of 30 to 60 ksi preferred.

The length of blocking component is sized or configured to accommodate 12 inch, 16 inch, and/or 24 inch on-center stud spacing.

The blocking component is also sized to fit 3⅝ inch, 4 inch, 6 inch, 8 inch, 10 inch, and/or 12 inch web sizes.

The leg/flange is preferably about 3 inches.

The nomenclature used in Industry Standard Blocking Nomenclature: TB362-300-S16-54, which is Track Blocking, 3⅝ inch web, 3 inch flange, Stud spacing of 16 inches on the center and 54 mils thick.

The blocking component is part of an assembly comprising a track and a stud. The exemplary tolerances for the stud and tracks' various dimensions are in the following TABLE I.

TABLE I

STUD AND TRACK REQUIREMENTS-ASTM C645

| Dimension [A] | Parameter | Drywall Studs, Inch (mm) | Drywall Track, Inch (mm) |
|---|---|---|---|
| A | Length | +⅛ (3.18)<br>−¼ (6.35) | +1 (25.40)<br>−¼ (6.35) |
| B[B] | Web width | +1/32 (0.79)<br>−1/32 (0.79) | +⅛ (3.18)<br>−0 (0) |
| C | Flare overbend | +1/16 (1.59)<br>−1/16 (1.59) | +0 (0)<br>−3/16 (4.76) |
| D | Hole center width | +1/16 (1.59)<br>−1/16 (1.59) | NA |
| E | Hole center length | +1/16 (1.59)<br>−1/16 (1.59) | NA |
| F | Crown | +1/16 (1.59)<br>−1/16 (1.59) | +⅛ (3.18)<br>−⅛ (3.18) |
| G | Camber | 1/32 per ft (0.79)<br>½ max (12.7) | 1/32 per ft (0.79)<br>½ max (12.7) |
| H | Bow | 1/32 per ft (0.79)<br>½ max (12.7) | 1/32 per ft (0.79)<br>½ max (12.7) |
| I | twist | 1/32 per ft (0.79)<br>½ max (12.7) | 1/32 per ft (0.79)<br>½ max (12.7) |

[A] All measurements shall be taken not less than 1 ft (305 mm) from the end.
[B] Outside dimension for Stud, Inside Dimension for Track.

While the blocking components disclosed herein may be manufactured using any number of manufacturing methods, the preferred manufacturing method is high speed roll forming of a metal material—such as steel. For example, the blocking component disclosed and shown in the Figures may originate as a single planar piece of metal having a length of at least 5 feet, preferably at least 8 feet, more preferably at least 10 feet. The planar piece of metal is then passed through a series of rolls to form the web, the first flange, and the second flange. The blocking component may be formed using traditional roll forming techniques surpassing 300 linear feet per minute in which the various bends originate from the center out.

The ears may be formed by exposing the piece of metal to a notching device such as a swedger, (also known as a swage), press, stamping machine, hand-held shears or the like which removes a portion of the metal material from opposing ends of the web area. This may occur prior to or after roll forming of the web, first flange, and second flange. The notching device is designed to repeatedly and precisely remove material from the roll formed part in one step to form the ears.

In other embodiments, the blocking components disclosed herein may be manufactured manually one part at a time via a press brake and shear.

Experimental

A series of experiments were conducted to test the load bearing capacity of various blocking components. In each experiment, a pair of studs was attached between an upper and lower track. The designated blocking component was then extended horizontally between and connected to the two studs by conventional metal framing assembly screws.

A force was applied at the center point of the designated blocking component to simulate the force applied by a cabinet, handrail or the like. This force was increased until a failure (i.e.—breakage of a portion of the blocking component, failure of the connection screw, breakage of a portion of one or both of the studs) occurred. The measured amount of force required to induce a failure is considered to be the load bearing capacity of the designated blocking component.

The following components were tested:

True Flatstrap blocking available from Telling Industries, Willoughby, Ohio, U.S.A. and referred to herein as "Comparative Example Blocking" or "CE".

A blocking component of the type described herein made of 16 ga 0.054 inch thick steel material and having 1.25 inch length ears (referred to herein as "Blocking Component 1" or "BC1").

A blocking component of the type described herein made of 30 mil 0.030 inch thick steel material and having 0.625 inch length ears (referred to herein as "Blocking Component 2" or "BC2").

A blocking component of the type described herein made of 18 ga 0.043 inch thick steel material and having 0.625 inch length ears (referred to herein as "Blocking Component 3" or "BC3").

A blocking component of the type described herein made of 16 ga 0.054 inch thick steel material and having 0.625 inch length ears (referred to herein as "Blocking Component 4" or "BC4").

20 EQ steel 0.019 inch thick studs and track (referred to herein as "Stud 1" or "S1").

12 ga 0.097 inch thick steel studs and track (referred to herein as "Stud 2" or "S2").

In the first group of experiments, the force was applied as an outward pulling force substantially perpendicular to the first flange plane simulating the force applied by a cabinet mounted external-to-the-wall. Each run was conducted three times with the pull load failure point being the average of the three runs. The results of the experiments are summarized below in Table II:

TABLE II

| Outward Pulling Force Pull Load Failure Point of Blocking Components | | | |
|---|---|---|---|
| Run No. | Stud | Blocking Component | Pull Load at Failure (lbs.) |
| 1 | S1 | CE | 73 |
| 2 | S1 | BC1 | 505 |
| 3 | S1 | BC2 | 457 |
| 4 | S1 | BC3 | 543 |
| 5 | S2 | CE | 101 |
| 6 | S2 | BC1 | 1820 |
| 7 | S2 | BC4 | 1799 |

As shown above in Table II, in each experiment the invented blocking component produced far superior load bearing capacity than the Comparative Example flat pieces of metal. It should be noted that in every instance the load bearing capacity of the invented blocking component exceeded the 200 pound minimum threshold required by Standard 1910.29 (Fall Protection for Handrails), Dec. 17, 2019 from the United States Department of Labor's Occupational Safety and Health Administration (OSHA).

An additional group of experiments were conducted in which the force was applied as a downward pulling force substantially parallel with the first flange plane simulating the force applied by a person pushing downward on a handrail mounted external-to-the-wall. Each run was conducted three times with the pull load failure point being the average of the three runs. The results of the experiments are summarized below in Table III:

TABLE III

| Downward Pulling Force Pull Load Failure Point of Blocking Components | | | |
|---|---|---|---|
| Run No. | Stud | Blocking Component | Pull Load at Failure (lbs.) |
| 8 | S1 | BC2 | 632 |
| 9 | S1 | BC4 | 1017 |
| 10 | S2 | BC4 | 1999* |

As shown above in Table III, in each experiment the invented blocking component produced load bearing capacity far exceeded the 200 pound minimum threshold required by OSHA regulations.

*It should be noted that, in Run No. 10, the test fixture maxed out at a pull load of 1999 pounds in all three runs without producing a failure. That is to say that the load bearing capacity in Run No. 10 exceeds the 1999 pound maximum pull load of the test fixture.

The blocking components described herein address many of the issues associated with previous attempts to utilize a hollow "C" shaped channel as a blocking component. Most notably, the blocking components described herein are capable of withstanding high weight loads as demonstrated in the experimental section above. Additionally, the blocking components described herein are relatively simple to manufacture using standard roll forming and cutting techniques. As the blocking components described herein do not utilize a folded attachment means for connecting to the studs, the potential for added failure points being introduced in the manufacturing process is reduced. The blocking components described herein are also simple to install to a stud without the need for precision alignment and/or additional clips.

The capacity of blocking under point loads was evaluated by an independent third party. These results are summarized in Table IV—CAPACITY OF BLOCKING UNDER POINT LOADS.

TABLE IV

CAPACITY OF BLOCKING UNDER POINT LOADS.

| | | Allowable Load (lbf)[c] Minimum Blocking [a] Thickness | |
|---|---|---|---|
| Stud and Track Thickness | Load Direction | 16 Gauge [54 mil][a] Fy = 50 ksi | 20 Gauge [30 mil][a] Fy = 33 ksi |
| 12 Gauge [97 mil] | Horizontal | 647 | — |
| Fy = 50 ksi | Vertical | 692 | — |
| 16 Gauge [54 mil] | Horizontal | 648 | — |
| Fy = 50 ksi | Vertical | 926 | — |
| 20 Gauge [30 mil] EQ | Horizontal | 288 | 249 |
| Fy = 33 ksi | Vertical | 396 | 339 |

[a]Blocking web is 3⅝ inches and blocking flange is 3 inches. Blocking notches are a minimum half of the width of the stud flange. Blocking is connected to the studs with (1) #10-16 screw in each flange.
[b]Spacing of the studs is 16 inches on center.
[c]Allowable loads are determined based on the test results and reliability analysis per AISI S100-16 Chapter K (updated 2018).
Fy is the Yield Force of the Steel with ksi being kilo pounds per square inch.

As shown in Table IV, in each experiment the load bearing capacity of the invented blocking component exceeded the 200 pound minimum threshold required by Standard 1910.29 (Fall Protection for Handrails), Dec. 17, 2019.

We claim:

1. A method for making a blocking component (100) for a construction framing assembly (10) having:

a web (110) having a rectangular planar profile, a web first edge (111), a web second edge (112) parallel with and opposite the web first edge, a web first end (113) perpendicular with the web first edge, a web second end (114) parallel with and opposite the web first end, a web top surface (115) and a web bottom surface (116);

a first flange (120) having a first flange first edge (121), a first flange second edge (122) parallel with and opposite the first flange first edge, a first flange first end (123) perpendicular with the first flange first edge, and a first flange second end (124) parallel with and opposite the first flange first end, said first flange first edge attached to the web first edge with said first flange extending away from the web bottom surface;

a second flange (130) having a second flange first edge (131), a second flange second edge (132) parallel with and opposite the second flange first edge, a second flange first end (133) perpendicular with the second flange first edge, and a second flange second end (134) parallel with and opposite the second flange first end, said second flange first edge attached to the web second edge with said second flange extending away from the web bottom surface; and a plurality of ears comprising:

a first ear (140) extending from the first flange first end;

a second ear (150) extending from the first flange second end;

a third ear (160) extending from the second flange first end; and a fourth ear (170) extending from the second flange second end;

said method is roll forming, comprising the steps of:

a. providing a planar piece of metal, b. passing the planar piece of metal through a series of rolls to make bends in the planar piece of metal to form the web, the first flange, and the second flange, c. forming the plurality of ears by removing a portion of the metal from opposing ends of the web.

2. The method of claim 1 wherein the bends in the planar piece of metal originate from a center of the planar piece of metal out.

3. The method of claim 2, wherein the removing of the portion of the metal is done by exposing the piece of metal to a notching device selected from the group consisting of a swage, a press, a stamping machine, or hand-held shears.

4. The method of claim 3, wherein the removing of the metal occurs prior to roll forming the web, the first flange, and the second flange.

5. The method of claim 3, wherein the removing of the metal occurs after roll forming the web, the first flange, and the second flange.

6. The method of claim 1, wherein the removing of the portion of the metal is done by exposing the planar piece of metal to a notching device selected from the group consisting of a swage, a press, a stamping machine, or hand-held shears.

7. The method of claim 6, wherein the removing of the metal occurs prior to roll forming the web, the first flange, and the second flange.

8. The method of claim 6, wherein the removing of the metal occurs after roll forming the web, the first flange, and the second flange.

9. The method of claim 1, wherein the removing of the metal occurs prior to roll forming the web, the first flange, and the second flange.

10. The method of claim 1, wherein the removing of the metal occurs after roll forming the web, the first flange, and the second flange.

* * * * *